United States Patent [19]

Stollberg

[11] 4,245,773

[45] Jan. 20, 1981

[54] CONTAINER WITH STACKING ALIGNMENT AND LATCHING STRUCTURE

[75] Inventor: Ray H. Stollberg, Gilroy, Calif.

[73] Assignee: Crown Zellerbach Corporation, San Francisco, Calif.

[21] Appl. No.: 68,781

[22] Filed: Aug. 22, 1979

[51] Int. Cl.[3] ..... B65D 13/00; B65D 5/32

[52] U.S. Cl. ..... 229/33; 229/DIG. 11; 229/36

[58] Field of Search ..... 229/33, 36, DIG. 11

[56] References Cited

U.S. PATENT DOCUMENTS

| | | | |
|---|---|---|---|
| 2,619,276 | 11/1952 | Gibbons | 229/33 |
| 2,721,689 | 10/1955 | Nye | 229/DIG. 11 |
| 2,843,307 | 7/1958 | Goltz | 229/36 X |
| 3,287,075 | 11/1966 | Batke et al. | 229/DIG. 11 |
| 3,713,579 | 1/1973 | Chaffers | 229/DIG. 11 |
| 4,134,533 | 1/1979 | Heaumer | 229/DIG. 11 |
| 4,142,665 | 3/1979 | Jewell et al. | 229/33 |
| 4,175,691 | 11/1979 | Cornell | 229/36 |

*Primary Examiner*—Davis T. Moorhead

*Attorney, Agent, or Firm*—Thomas R. Lampe

[57] ABSTRACT

A container comprising the combination of a box body having a bottom wall and interconnecting side walls defining a box interior, a cover for the box body having at least one aperture formed therein, latch means attached to at least one of the side walls positionable in an aperture with a portion of said latch means extending beyond said cover and in engagement therewith when the cover is positioned on the box body, and auxiliary lock means on the cover for maintaining the latch means portion in engagement with the cover. At least one opening is formed in the container bottom wall for accommodating latch means of a container of like construction when stacked thereupon.

7 Claims, 8 Drawing Figures

CONTAINER WITH STACKING ALIGNMENT AND LATCHING STRUCTURE

BACKGROUND AND OBJECTS OF THE INVENTION

The packing and shipping of produce such as grapes, tomatoes, cherries, etc. calls for the usage of specialized boxes of sturdy construction that are readily assembled and stacked. In addition, it is desirable to incorporate latch means on containers of this type to maintain the integrity of the box, especially during shipping.

Many types of produce are picked and packed into boxes in the field, rather than being transported to other locations for further processing prior to final packing. It is therefore advantageous to have a container that can be closed by the field worker without the use of additional material or equipment. Additionally, a container of this type should preferably be closed and latched without the use of staples, glue, tape or other auxiliary closure materials. Yet another desirable container feature is to provide a closure latching mechanism that can be readily reopened, as by government inspectors or prospective customers, and then reclosed without damaging the latching structure. Finally, it is desirable to have a shipping container wherein the box body and cover components thereof are formed from a unitary blank.

It is therefore an object of the present invention to provide a container of unitary construction featuring latch means for holding the cover component on the box body component in a positive fashion and yet permitting ready inspection of the contents of the container without harming said latch means.

It is a further object of the present invention to provide a container that may readily be closed and locked in said closed condition without the use of auxiliary material or equipment.

It is yet another object of the present invention to provide a container having a specialized latching structure which functions in the dual capacity of a stacking alignment mechanism.

SUMMARY OF THE INVENTION

According to the present invention, a container particularly useful for the packing and shipping of produce and similar material is provided which is of simple and economical construction and yet has the characteristics desired in such a container. In particular, the container is of unitary construction and includes a box body, a cover for the box body having at least one aperture formed therein having first and second aperture segments in a communication with one another, latch means extending from the box body and positionable within the second aperture segment with a portion of the latch means extending beyond and bearing against the cover when the cover is positioned on the box body, and auxiliary lock means in the form of a flap operatively associated with the cover and selectively movable from an open position wherein the first aperture segment is unobstructed to a closed position wherein the first aperture segment is closed, said flap bearing against the latch means to maintain it within the second aperture segment when the flap is in its closed position.

Other objects and characteristics of the invention will be apparent from the following more detailed description and accompanying drawings in which:

DETAILED DESCRIPTION

Figure 3:
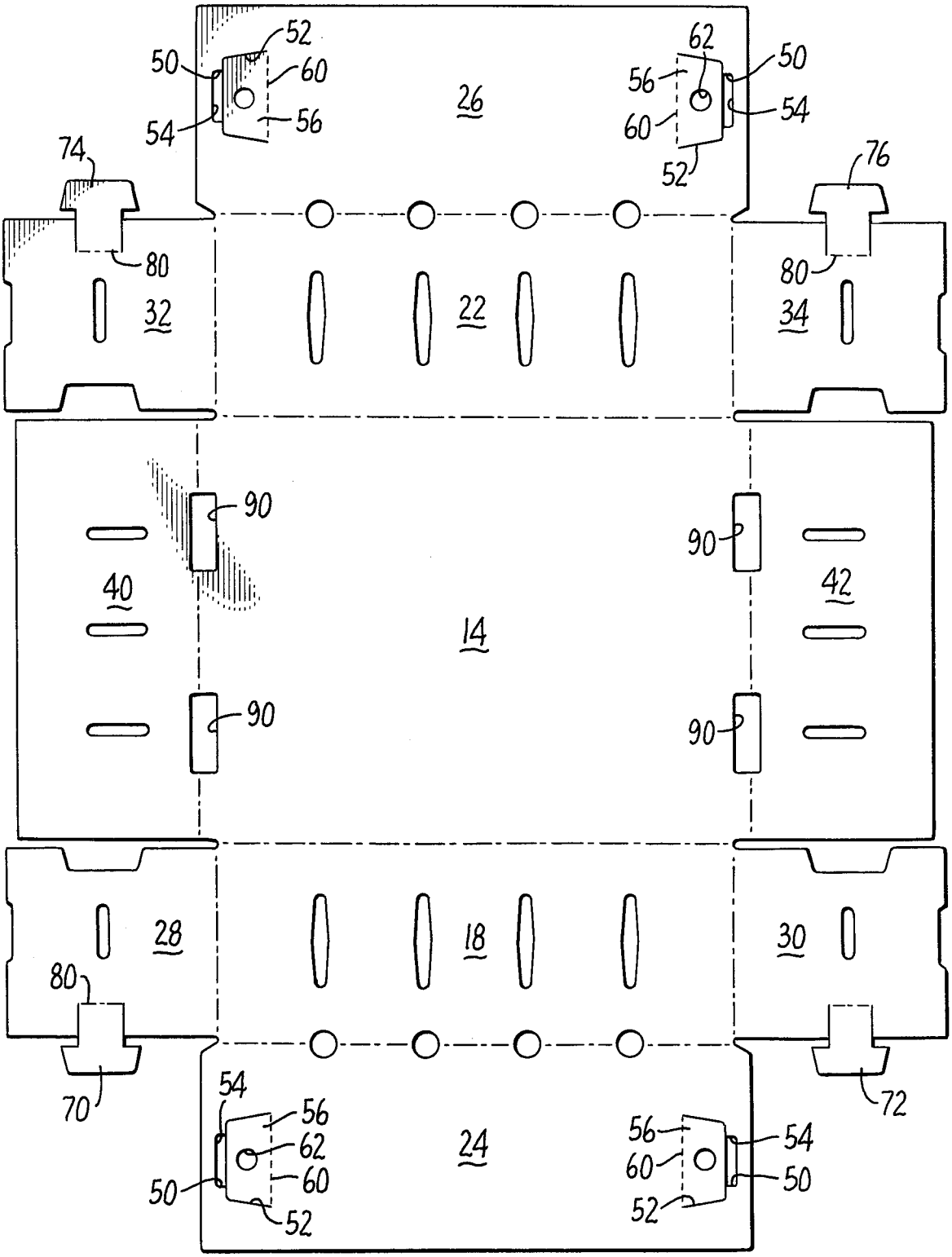
FIG. 3 is a plan view of the blank utilized in the construction of the container.

FIGS. 1, 2 and 4–8 illustrate the container of the present invention and FIG. 3 illustrates the unitary blank from which said container is assembled. As shown, the container is formed of a blank of two-ply fiberboard material. It will be appreciated, however, that any suitable material may be employed such as double wall or triple wall corrugated paperboard. The container includes a box body generally indicated by reference numeral 12 having a bottom wall 14 and interconnecting side walls 16, 18, 20 and 22 which define a box interior. Hingedly connected to side walls 18 and 22 are cover portions 24 and 26, respectively. As may best be seen with reference to FIG. 3, which shows the blank utilized to construct the container, side walls 18 and 22 have hingedly connected to the ends thereof inner flaps 28, 30, 32 and 34, said flaps when folded over and brought into face-to-face engagement with outer end walls components 40 and 42 hingedly connected to bottom wall 14 form conjointly therewith side walls 16 and 20. The inner flaps are glued or otherwise secured to the outer end wall components to maintain the box body in a rectangular-shaped configuration.

Apertures 50 are formed in the ends of cover portions 24 and 26 as shown. A first segment 52 of each aperture 50 is in the form of a truncated triangle. Each first aperture segment 52 communicates with a second aperture segment 54 which is generally rectangular-shaped with the longitudinal dimension thereof being substantially less than the minimum corresponding dimension of the first aperture segment. Each first aperture segment cooperates with auxiliary lock means 56 formed in the cover portion. Each lock means 56 is movable about a fold line 60 between an open position wherein its associated first aperture segment 52 is unobstructed to a closed position wherein its associated first aperture segment is closed. Normally the lock means assume the closed position unless manually manipulated to an open position as by insertion of a finger in a finger hole 62 formed in the lock means.

Inner flaps 28, 30, 32 and 34 have attached thereto latch means 70, 72, 74 and 76, respectively. Each of the latch means is of identical construction so only one, latch means 70, will be described in detail. Latch means 70 is integrally formed with inner flap 28 and is manually movable with respect thereto along fold line 80. Latch means 70 has a substantially T-shaped configuration with the upper cross arms of the T defining shoulders spaced from its associated inner flap 28. It is readily apparent that when inner flap 28 is brought into face-to-face communication with outer end wall component 40 to form side wall 16 that latch means 70 projects upwardly from said side wall.

Figure 6:
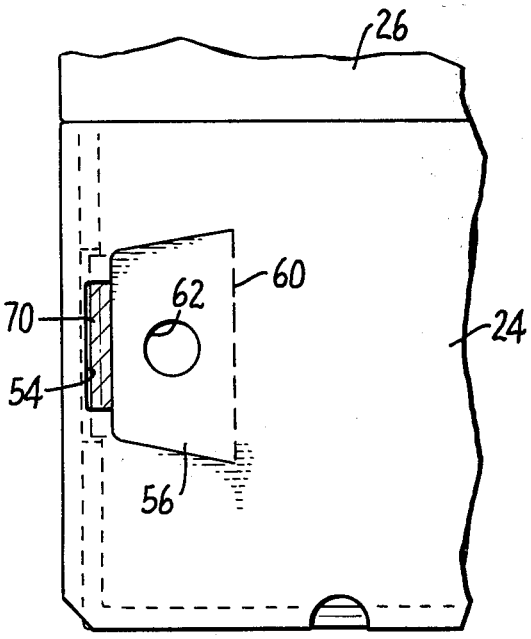
FIG. 6 is a sectional view taken along the line 6—6 in FIG. 4.
Figure 7:
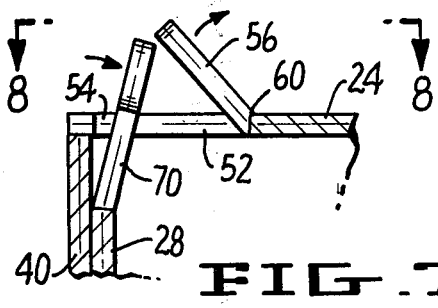
FIG. 7 is a transverse sectional view showing operative details of the latch means and auxiliary lock means of the container.
Figure 8:
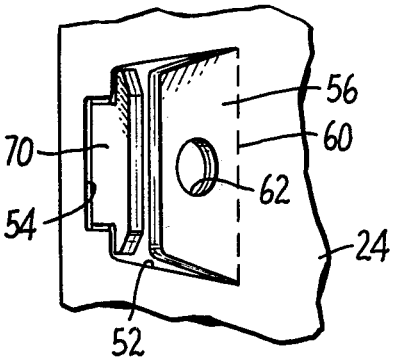
FIG. 8 is a sectional view taken along the line 8—8 in FIG. 7.

Latch means 70 is adapted to enter into an aperture 50 formed in cover portion 24 when the cover portion is folded over to be positioned over the box interior. Normally, latch means 70 is in alignment with the second aperture segment 54 of its associated aperture 50 but manual manipulation thereof about fold line 80 will enable the latch means to enter first aperture segment 52 which is large enough to accommodate the outermost extent, i.e. shoulders, of latch means 70. This relationship is best shown in FIGS. 7 and 8. Prior to latch means 70 entering its associated aperture 50 the lock means 56 associated therewith may be manually manipulated out of the way; alternatively, engagement of the means by the latch means may be enough to bend the means into its open position. After the latch means has entered aperture 50 it is moved to the second aperture segment 54 thereof. The associated means 56 will then be pushed down by the packer so that it bears against the side of the latch means 70 and retains it in its latching position in second aperture segment 54 as shown in FIG. 6. When it is desired to unlatch the aforedescribed structure, the packer merely moves means 56 out of first aperture segment 52 so that the latch means may be manually displaced into the first aperture segment and the cover portion opened.

Figure 1:
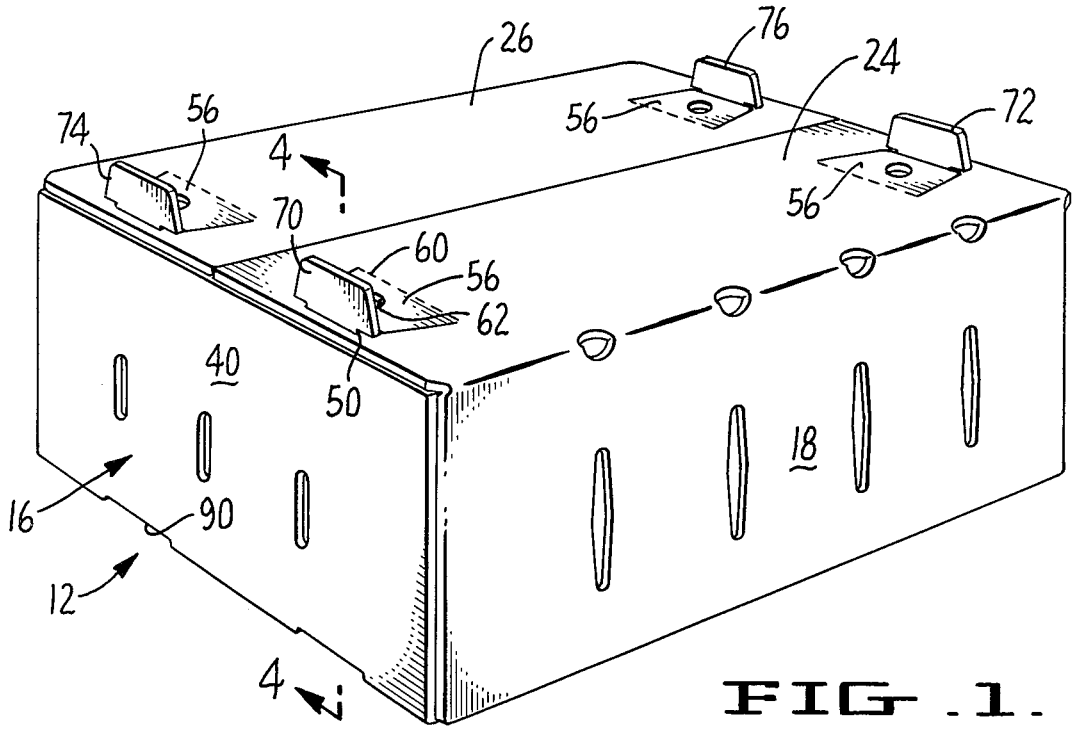
FIG. 1 is a perspective view of a closed container constructed according to the teachings of the present invention.
Figure 2:
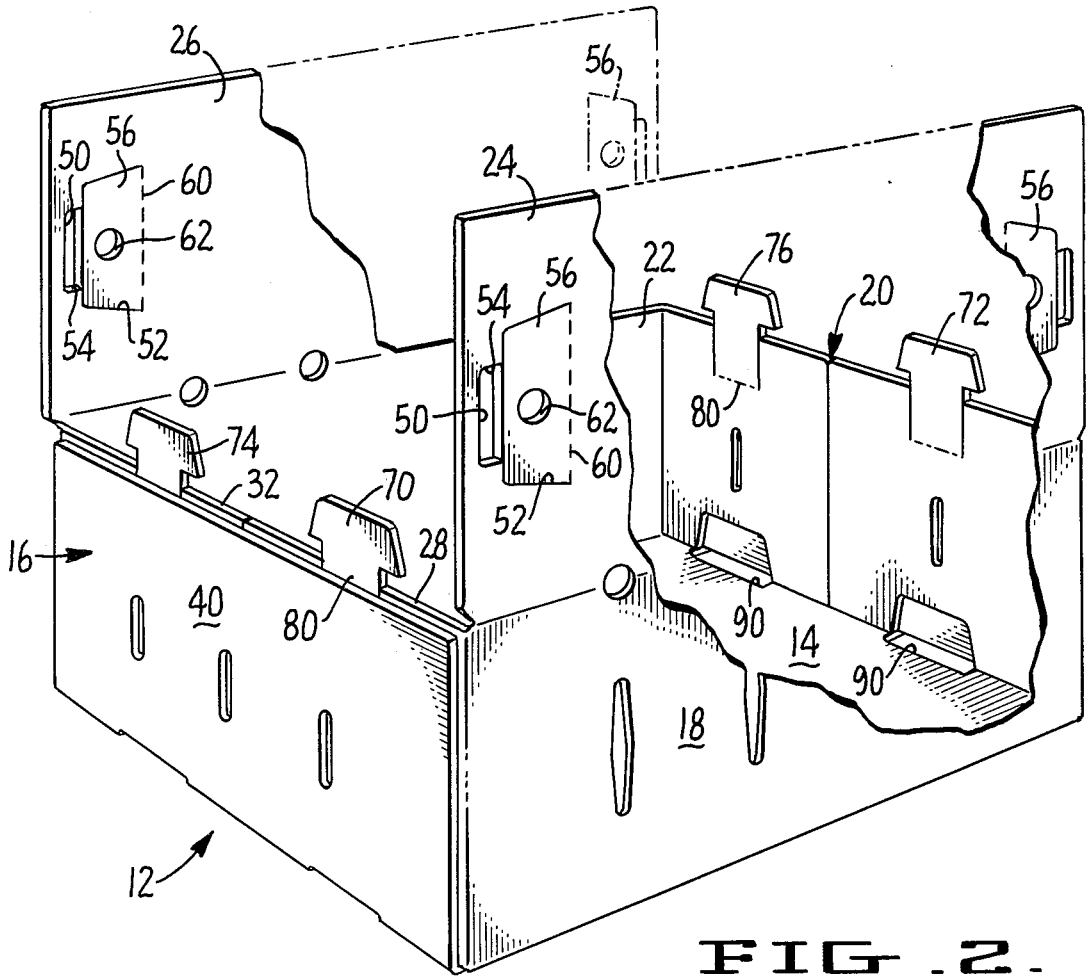
FIG. 2 is a perspective, partially broken away view of the container opened.
Figure 4:
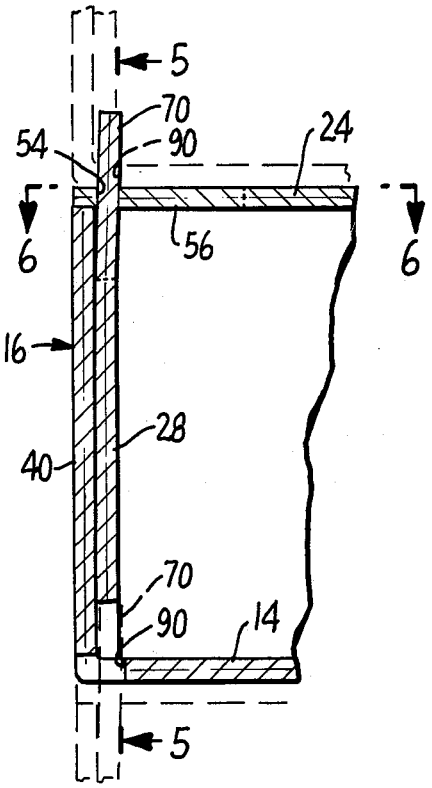
FIG. 4 is a sectional view taken along the line 4—4 in FIG. 1 showing the container in stacked relationship with containers of like construction which are shown in phantom.
Figure 5:
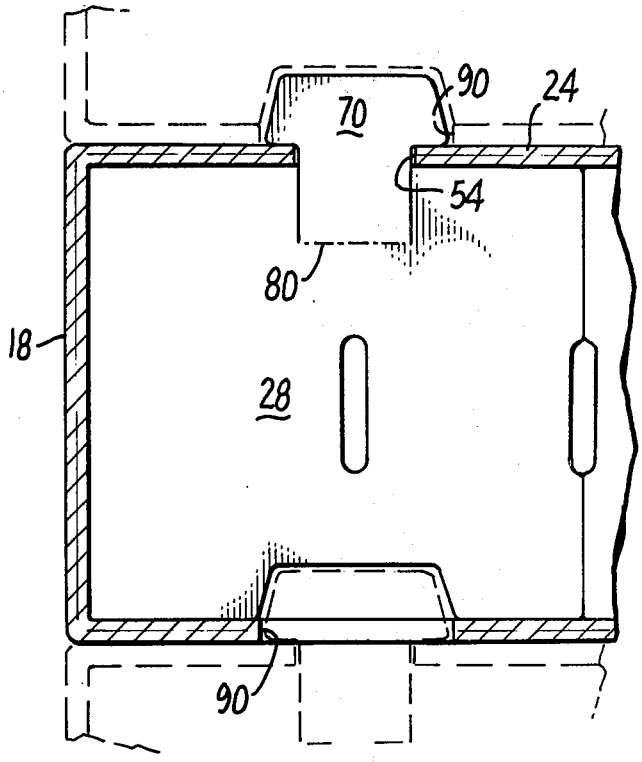
FIG. 5 is a sectional view taken along the line 5—5 in FIG. 4.

When the cover comprising cover portions 24 and 26 is positioned over the box body interior and latched into position by the four latch means shown, the latch means project upwardly from their associated side walls 16 and 20 as shown in FIGS. 1, 4 and 5. The bottom wall 14 of the container has openings 90 formed therein which are in vertical alignment with the latch means when the latch means are disposed in their respective second aperture segments 54. Thus, when containers of construction are stacked one upon the other, the latch means of a lower container enter into the apertures 90 of the container stacked thereon. In this manner lateral shifting of the stack is prevented. This relationship is shown in FIGS. 4 and 5 wherein a container is shown in solid lines with containers of like construction shown in phantom above and below it in stacked formation.

It will be appreciated that various changes may be made in the disclosed embodiment without departing from the spirit of the present invention. For example, the first segment 52 of each aperture 50 may be in the form of a rectangle rather than a truncated triangle as shown.

I claim:

1. A container comprising the combination of:

a box body having a bottom wall and interconnecting side walls defining a box interior:

a cover for said box body having at least one aperture formed therein, latch means attached to at least one of said side walls, each said latch means positionable in an aperture with a portion thereof extending above said cover in latching position when said cover is positioned over said box interior; and auxiliary lock means on said cover for maintaining said latch means in latching position with respect to said cover, said cover aperture including a first aperture segment accommodating said lock means and a second aperture segment in communication with said first aperture segment, said latch means assuming a latching position in said second aperture segment when said cover is positioned over said box interior, and said lock means being connected to the rest of said cover along a fold line and selectively manually movable about the fold line from an open position wherein said first aperture segment is unobstructed to a closed position wherein said first aperture segment is closed, and said lock means bearing against said latch means when said lock means is in said closed position.

2. The container of claim 1 wherein said cover is comprised of a plurality of cover portions, each of said cover portions having latch means operatively associated therewith.

3. The container of claim 1 wherein said latch means comprises a plurality of T-shaped elements integrally formed with said side walls.

4. The container of claim 1 wherein said bottom wall has at least one opening formed therein for accommodating latch means of a container of like construction when stacked thereupon.

5. The container of claim 1 formed from a blank of unitary construction.

6. A container comprising:

a box body having a bottom wall and interconnecting side walls defining a box interior;

a cover for said box body having at least one aperture formed therein having first and second aperture segments in communication with one another;

auxilliary lock means comprising part of said cover and connected to the rest of said cover along a hinge line, said lock means being selectively manually movable about said hinge line from an open position wherein said first aperture segment is unobstructed to a closed position wherein said first aperture segment is closed by said lock means; and latch means extending from said box body and positionable within said second aperture segment with a portion of said latch means extending above said cover when said cover is positioned over said box interior and said lock means bearing against said latch means when said lock means is in said closed position.

7. The container of claim 6 formed from a blank of unitary construction.

* * * * *